US008929780B2

(12) United States Patent
Yamabe et al.

(10) Patent No.: US 8,929,780 B2
(45) Date of Patent: Jan. 6, 2015

(54) TONER CONTAINER, IMAGE FORMING APPARATUS, TONER CONTAINER PRODUCING METHOD AND TONER CONTAINER RECYCLING METHOD

(75) Inventors: Junji Yamabe, Shizuoka (JP); Masato Suzuki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 217 days.

(21) Appl. No.: 13/576,275

(22) PCT Filed: Feb. 23, 2011

(86) PCT No.: PCT/JP2011/054665

§ 371 (c)(1),
(2), (4) Date: Jul. 31, 2012

(87) PCT Pub. No.: WO2011/108554

PCT Pub. Date: Sep. 9, 2011

(65) Prior Publication Data

US 2012/0301188 A1 Nov. 29, 2012

(30) Foreign Application Priority Data

Mar. 1, 2010 (JP) ..... 2010-044052

(51) Int. Cl.
*G03G 15/08* (2006.01)

(52) U.S. Cl.
CPC .... *G03G 15/0832* (2013.01); *G03G 2215/0668* (2013.01)
USPC ..... 399/262

(58) Field of Classification Search
CPC ..... G03G 15/0832; G03G 2215/0668; G03G 15/0837; G03G 15/0836; G03G 15/0839
USPC ..... 399/258, 260, 262
See application file for complete search history.

(56) References Cited

U.S. PATENT DOCUMENTS 6,298,208 B1 10/2001 Kawamura et al.
7,184,691 B2 * 2/2007 Kita et al. ..... 399/262

(Continued)

FOREIGN PATENT DOCUMENTS

JP 2000-214669 A 8/2000
JP 3628539 12/2004

(Continued)

OTHER PUBLICATIONS

Office Action issued Jan. 10, 2014 in Japanese Patent Application No. 2010-044052.

(Continued)

*Primary Examiner* — Susan Lee
(74) *Attorney, Agent, or Firm* — Oblon, Spivak, McClelland, Maier & Neustadt, L.L.P.

(57) ABSTRACT

A toner container detachably mountable to an image forming apparatus, the toner container including: a cylindrical container which accommodates a toner; a cap portion which holds the cylindrical container such that the cylindrical container can rotate in a circular direction, with an end of the cylindrical container inserted in the cap portion; and a sealing member lying between the end and an inner surface of the cap portion, wherein the toner in the cylindrical container is discharged to an inside of the cap portion through an opening provided in the end and the toner in the cap portion is discharged to an outside through a toner discharge port provided in the cap portion, as the cylindrical container rotates, and wherein the cylindrical container is provided with a seal receiving surface for fixing the sealing member, and the sealing member is fixed to the seal receiving surface.

11 Claims, 9 Drawing Sheets

(56) References Cited

U.S. PATENT DOCUMENTS

| | | | | |
|---|---|---|---|---|
| 2004/0190945 | A1* | 9/2004 | Yamada | 399/258 |
| 2005/0157109 | A1 | 7/2005 | Muranaka et al. | |
| 2005/0196198 | A1 | 9/2005 | Kawamura et al. | |
| 2006/0251448 | A1 | 11/2006 | Kawamura et al. | |
| 2007/0077100 | A1 | 4/2007 | Suzuki et al. | |
| 2009/0279916 | A1* | 11/2009 | Naito et al. | 399/262 |
| 2011/0038647 | A1 | 2/2011 | Kawamura et al. | |

FOREIGN PATENT DOCUMENTS

| | | | |
|---|---|---|---|
| JP | 2009-223047 | | 10/2009 |
| JP | 2009-271279 | | 11/2009 |
| TW | 556058 | | 10/2003 |
| TW | 200941164 | A1 | 10/2009 |
| WO | WO2009/116655 | A1 | 9/2009 |

OTHER PUBLICATIONS

Combined Taiwanese Office Action and Search Report issued Aug. 7, 2013, in Taiwanese Application No. 100106712 with English translation.

International Search Report Issued on Mar. 29, 2011 in PCT/JP2011/054665 filed Feb. 23, 2011.

* cited by examiner

TONER CONTAINER, IMAGE FORMING APPARATUS, TONER CONTAINER PRODUCING METHOD AND TONER CONTAINER RECYCLING METHOD

TECHNICAL FIELD

The present invention relates to a toner container, such as a toner cartridge, detachably mountable to a main body of an image forming apparatus; and an image forming apparatus using this toner container. The present invention also relates to a toner container producing method for producing a toner container; and a toner container recycling method for recycling a toner container which has been used.

BACKGROUND ART

As a known toner container of this type, there is a toner cartridge of cylinder rotation type equipped with a cylindrical container and a cap portion which holds an end of the cylindrical container in a rotatable manner (for example, the one described in PTL 1). FIG. 1 is an exploded cross-sectional view showing an end of a conventional toner cartridge of cylinder rotation type. In the drawing, a toner cartridge 500 includes a ring-shaped sealing member 501, a cap portion 510 serving as a lid, and a cylindrical container 530 in the form of a long cylinder. In the drawing, for the sake of convenience, the cap portion 510, the sealing member 501 and the cylindrical container 530 are separately shown, but in reality these are installed in a unified manner as shown in FIG. 2. Also, for the sake of convenience, regarding the cylindrical container 530, only an end thereof with respect to the cylinder axis direction is shown.

On the inner circumferential surface of a large-diameter cylindrical structure 511 of the cap portion 510, there is provided a hook portion 512 protruding toward the inner side of the cylinder. The cap opening side of this hook portion 512 is in a tapered form, whereas the opposite side thereof is in the form of a wall which rises substantially vertically from the circumferential surface. This surface which rises substantially vertically serves as a catching surface for catching the after-mentioned outer circumferential protrusion 533 on.

In the end of the cylindrical container 530, there is provided a container opening 531. On the outer circumferential surface of the end of the cylindrical container 530, there is provided an outer circumferential protrusion 533 extending around the whole circumference. Further, in the cylindrical container 530, there is provided a spiral groove 532 which is depressed (as if in an embossed portion) from the outer side toward the inner side of the container. This spiral groove 532 is in a spiral concave form as seen from the outside of the container but is in a spiral convex form as seen from the inside of the container.

Into the cap portion 510, the ring-shaped sealing member 501 and the end of the cylindrical container 530 are inserted as shown by the arrows in the drawing. At this time, the outer circumferential protrusion 533 of the cylindrical container 530 moves beyond the tapered protrusion of the hook portion 512 of the cap portion 510. Then the end of the cylindrical container 530 adheres to the sealing member 501. In this state, since the outer circumferential protrusion 533 of the cylindrical container 530 is caught by the catching surface of the hook portion 512, the cylindrical container 530 can be rotatably held by the cap portion 510 as shown in FIG. 2, without detaching from the cap portion 510.

In the main body of an image forming apparatus, when the cylindrical container 530 of the toner cartridge 500 is rotationally driven by a drive unit (not shown), a toner (not shown) accommodated in the cylindrical container 530 moves from the right-hand side toward the left-hand side in the drawing due to the spiral motion of the spiral groove 532. Then the toner moves into the large-diameter cylindrical structure 511 of the cap portion 510 through the container opening (denoted by 531 in FIG. 1) of the cylindrical container 530. Thereafter, the toner is discharged from a toner discharge port 515 of the cap portion 510 to the outside and then supplied into a developing device (not shown) that is a part of an image forming unit.

In the above structure, the ring-shaped sealing member 501 is affixed to a back surface of the cap portion 510 with double-sided tape so as not to detach.

CITATION LIST

Patent Literature

PTL 1 Japanese Patent (JP-B) No. 3628539

SUMMARY OF INVENTION

Technical Problem

However, since the internal diameter of the cap portion 510 is smaller than the humans palm, it is very difficult to detach the sealing member 501 affixed to a back surface 513 of the cap portion 510. Thus, re-affixation of the sealing member 501 (in the case where it has been affixed in the wrong position) and replacement of the sealing member 501 (in the case where the toner cartridge 500 is recycled) will be troublesome, thereby possibly leading to an increase in costs.

The present invention is designed in light of the above-mentioned background and aimed at solving the problems in related art and achieving the following objects. An object of the present invention is to provide a toner container and an image forming apparatus which enable a sealing member to be easily reaffixed and replaced. Another object of the present invention is to provide a toner container producing method for producing the toner container, and a toner container recycling method for recycling the toner container after it has been used.

Solution to Problem

Means for solving the problems are as follows:

<1> A toner container detachably mountable to a main body of an image forming apparatus, the toner container including: a cylindrical container which accommodates a toner; a cap portion which holds the cylindrical container such that the cylindrical container can rotate in a circular direction, with an end of the cylindrical container inserted in the cap portion; and a sealing member which lies between the end and an inner surface of the cap portion with the end inserted therein, wherein the toner in the cylindrical container is discharged to an inside of the cap portion through an opening provided in the end and the toner in the cap portion is discharged to an outside through a toner discharge port provided in the cap portion, as the cylindrical container rotates, and wherein the cylindrical container is provided with a seal receiving surface for fixing the sealing member, and the sealing member is fixed to the seal receiving surface.

<2> The toner container according to <1>, further including an outer wall which rises from the seal receiving surface and which is provided on an outer circumferential edge of the seal receiving surface.

<3> The toner container according to <2>, wherein the outer wall has a height which is greater than a thickness of the sealing member.

<4> The toner container according to <2> or <3>, further including an inner wall which rises from the seal receiving surface and which is provided on an inner circumferential edge of the seal receiving surface, wherein the sealing member is a ring-shaped sealing member, and the seal receiving surface is a ring-shaped seal receiving surface.

<5> The toner container according to <4>, further including a ring-shaped protrusion whose external diameter $D_3$ is smaller than an external diameter $D_1$ of the ring-shaped sealing member and whose internal diameter $D_4$ is greater than an internal diameter $D_2$ of the ring-shaped sealing member, the ring-shaped protrusion being provided on the seal receiving surface.

<6> The toner container according to <5>, further including a ring-shaped protrusion whose external diameter $D_5$ is smaller than the external diameter $D_1$ of the ring-shaped sealing member and whose internal diameter $D_6$ is greater than the internal diameter $D_2$ of the ring-shaped sealing member, the ring-shaped protrusion being provided on a surface in the cap portion opposite the seal receiving surface.

<7> The toner container according to any one of <4> to <6>, further including a concavo-convex pattern which has a level difference with respect to a normal direction and which is provided at an inner circumferential surface of the outer wall, and an engaging concavo-convex pattern which can engage with the concavo-convex pattern and which is provided at an outer edge of the ring-shaped sealing member.

<8> An image forming apparatus including: an image forming unit configured to form an image, using a toner; and a toner container which accommodates a toner to be supplied to the image forming unit and which is detachably mountable to a main body of the image forming apparatus, wherein the toner container is the toner container according to any one of <1> to <7>.

<9> A toner container producing method including: producing a toner container by using a cylindrical container provided with a seal receiving surface for fixing a sealing member, and by allowing an end of the cylindrical container, with the sealing member fixed to the seal receiving surface of the cylindrical container, to engage with a cap portion, wherein the toner container is detachably mountable to a main body of an image forming apparatus and includes: the cylindrical container which accommodates a toner; the cap portion which holds the cylindrical container such that the cylindrical container can rotate in a circular direction, with the end of the cylindrical container inserted in the cap portion; and the sealing member which lies between the end and an inner surface of the cap portion with the end inserted therein, and wherein the toner in the cylindrical container is discharged to an inside of the cap portion through an opening provided in the end and the toner in the cap portion is discharged to an outside through a toner discharge port provided in the cap portion, as the cylindrical container rotates.

<10> A toner container recycling method for recycling a toner container which has been used, including: pulling a cylindrical container from a cap portion of the toner container which has been used; detaching a sealing member from a seal receiving surface provided on the cylindrical container; fixing an unused sealing member to the seal receiving surface; filling the cylindrical container with a toner; and allowing the cylindrical container filled with the toner to engage with the cap portion, to thereby obtain a recycled toner container, wherein the toner container is detachably mountable to a main body of an image forming apparatus and includes: the cylindrical container which accommodates the toner; the cap portion which holds the cylindrical container such that the cylindrical container can rotate in a circular direction, with an end of the cylindrical container inserted in the cap portion; and the sealing member which lies between the end and an inner surface of the cap portion with the end inserted therein, and wherein the toner in the cylindrical container is discharged to an inside of the cap portion through an opening provided in the end and the toner in the cap portion is discharged to an outside through a toner discharge port provided in the cap portion, as the cylindrical container rotates.

Advantageous Effects of Invention

In these inventions, by fixing a sealing member to a seal receiving surface provided at an end of a cylindrical container of a toner container, it is possible to prevent detachment of the sealing member from the toner container in operation. Moreover, since a wall that hinders access of a human hand is not present at the end of the cylindrical container provided with the seal receiving surface, unlike on the inside of a cap portion, the sealing member fixed to the seal receiving surface at the end of the cylindrical container can be easily removed by the human hand. Hence, the sealing member can be easily reaffixed and replaced.

DESCRIPTION OF EMBODIMENTS

The following explains an embodiment of an electrophotographic printer (hereinafter referred to simply as "printer") as an image forming apparatus to which the present invention has been applied.

Figure 1:
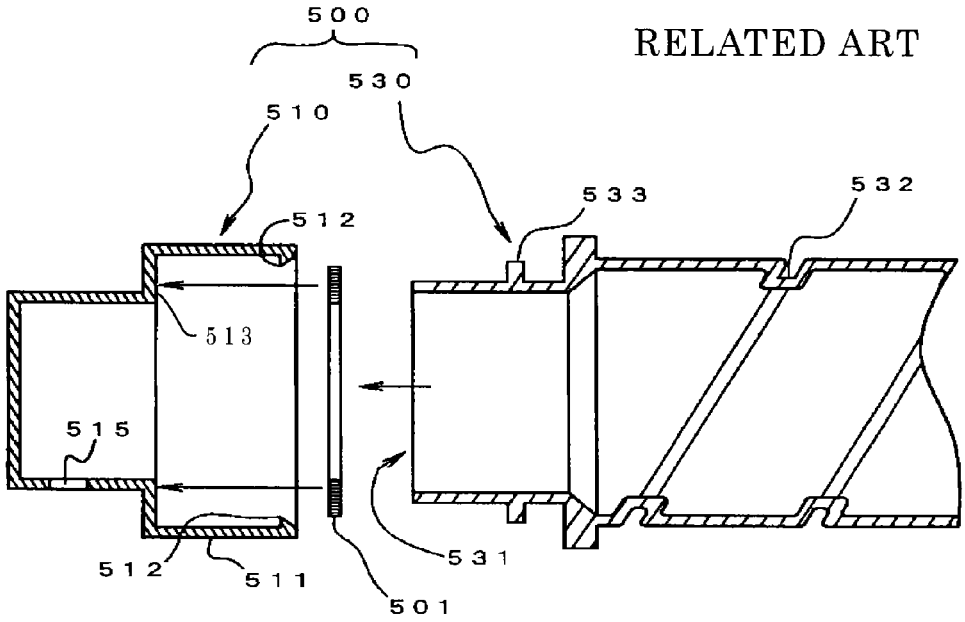
FIG. 1 is an exploded cross-sectional view showing an end of a conventional toner cartridge of cylinder rotation type.
Figure 2:
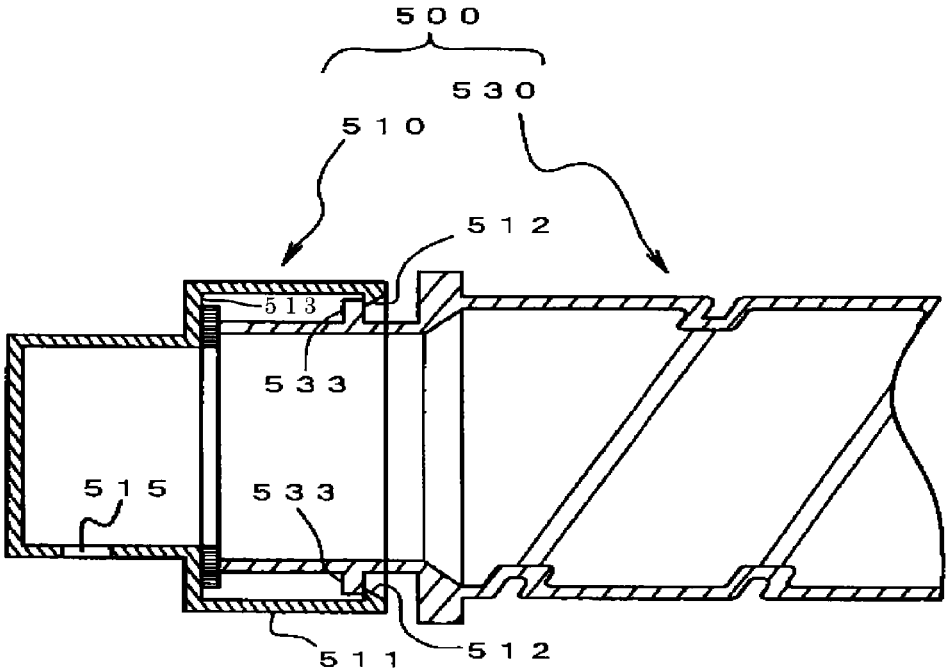
FIG. 2 is a cross-sectional view showing the end when a cylindrical container has been attached to a cap portion.
Figure 3:
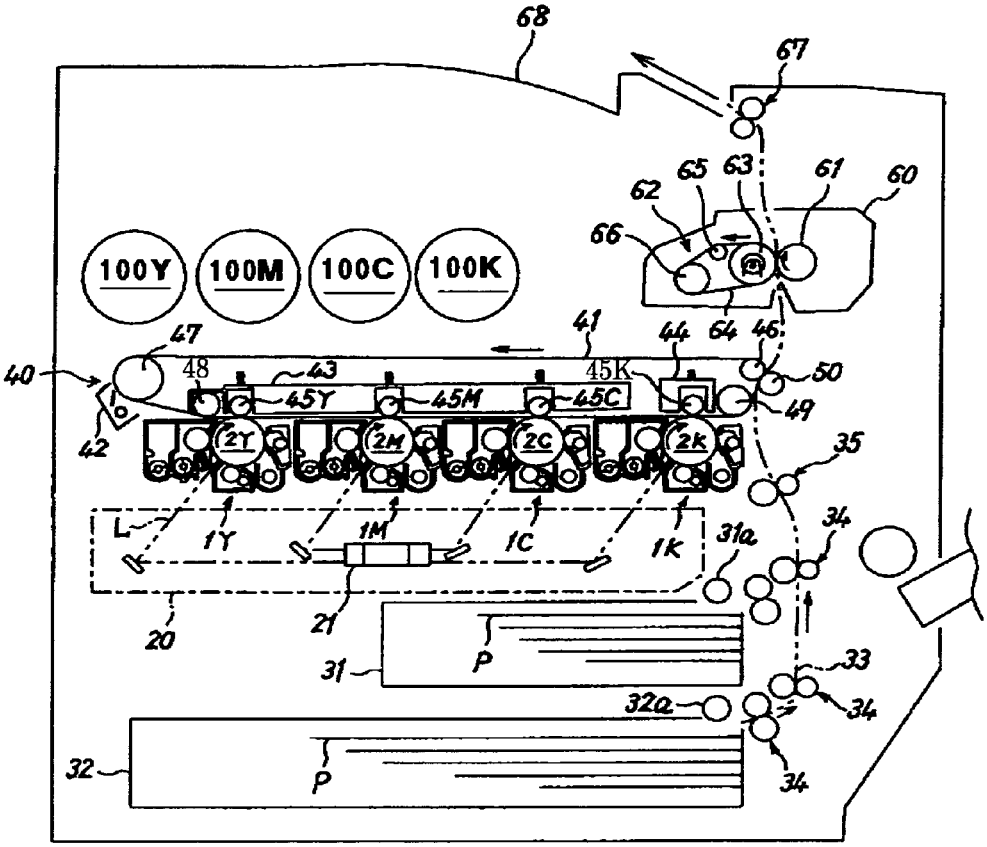
FIG. 3 is a schematic structural drawing showing a printer according to an embodiment.
Figure 4:
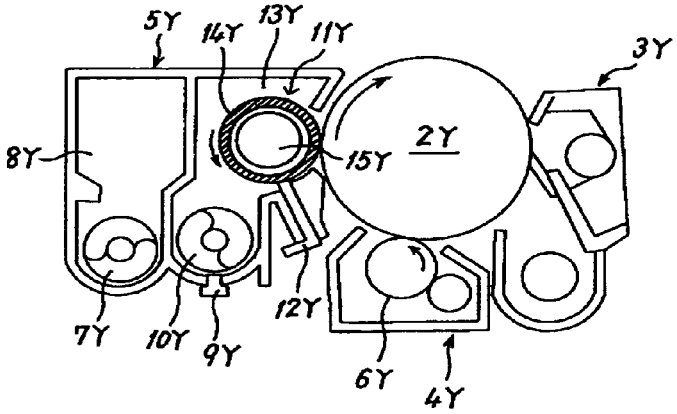
FIG. 4 is an enlarged structural drawing showing a process cartridge for Y (yellow) in the printer.

First of all, the fundamental structure of the printer is explained. FIG. 3 is a schematic structural drawing showing the printer. In the drawing, the printer includes four process cartridges 1Y, 1M, 1C and 1K for forming toner images of yellow, magenta, cyan and black respectively (note that yellow, magenta, cyan and black will be written for short as "Y", "M", "C" and "K" respectively). Respectively using Y, M, C and K toners that differ from one another in color as image forming materials for forming images, these process cartridges have similar structures and are replaced when their lifetimes end. Take, for example, the process cartridge 1Y for forming a Y toner image: the process cartridge 1Y includes a drum-like photoconductor 2Y, a drum cleaning device 3Y, a charge eliminating device (not shown), a charging device 4Y, a developing device 5Y and so forth, as shown in FIG. 4. This process cartridge 1Y is detachably mountable to the main body of the printer in an integral manner, and so consumable parts can be replaced at one time.

The charging device 4Y uniformly charges the surface of the photoconductor 2Y rotated in a clockwise direction in the drawing by a drive unit (not shown). The drawing shows the charging device 4Y configured to uniformly charge the photoconductor 2Y by bringing a charging roller 6Y, which is rotationally driven in a counterclockwise direction in the drawing, into contact with the photoconductor 2Y while a charging bias is being applied by a power source (not shown). A charging device which brings a charging brush, instead of the charging roller 6Y, into contact with the photoconductor may be used as well. Alternatively, a charging device configured to charge the photoconductor 2Y in a noncontact manner, e.g., a scorotron charger, may be used. The surface of the photoconductor 2Y uniformly charged by the charging device 4Y is scanned with laser light emitted from the after-mentioned optical writing unit and bears a latent electrostatic image for Y.

The developing device 5Y includes a first agent accommodating portion 8Y provided with a first conveyance screw 7Y. It also includes a second agent accommodating portion 13Y provided with a toner concentration sensor (hereinafter referred to as "T sensor") 9Y based upon a magnetic permeability sensor, a second conveyance screw 10Y, a developing roll 11Y, a doctor blade 12Y and so forth. In these two agent accommodating portions, a Y developer (not shown) composed of a magnetic carrier and a negatively chargeable Y toner is encapsulated. Rotationally driven by a drive unit (not shown), the first conveyance screw 7Y conveys the Y developer in the first agent accommodating portion 8Y from the near side toward the far side with respect to the direction perpendicular to the face shown by the drawing. Then the Y developer enters the second agent accommodating portion 13Y through a communication port (not shown) provided in a partition wall provided between the first agent accommodating portion 8Y and the second agent accommodating portion 13Y. Rotationally driven by a drive unit (not shown), the second conveyance screw 10Y in the second agent accommodating portion 13Y conveys the Y developer from the far side toward the near side with respect to the direction perpendicular to the face shown by the drawing. The toner concentration of the Y developer being conveyed is detected by the T sensor 9Y fixed to the bottom of the second agent accommodating portion 13Y.

Above (in the drawing) the second conveyance screw 10Y that thusly conveys the Y developer, the developing roll 11Y is placed parallel, including a nonmagnetic pipe 14Y rotationally driven in a counterclockwise direction in the drawing, and a magnet roller 15Y encapsulated in the nonmagnetic pipe 14Y. The Y developer conveyed by the second conveyance screw 10Y is drawn up onto the surface of the nonmagnetic pipe 14Y by the magnetic force generated by the magnet roller 15Y. Then the layer thickness of the Y developer is regulated by means of the doctor blade 12Y placed with a predetermined amount of space kept between it and the nonmagnetic pipe 14Y, subsequently the Y developer is conveyed to a developing region that faces the photoconductor 2Y, and the Y toner is attached to the latent electrostatic image for Y on the photoconductor 2Y. By this attachment, a Y toner image is formed on the photoconductor 2Y. The Y developer whose Y toner has been consumed due to the development is returned onto the second conveyance screw 10Y as the nonmagnetic pipe 14Y of the developing roll 11Y rotates. When the Y developer has been conveyed to an end on the near side in the drawing, it returns into the first agent accommodating portion 8Y through a communication port (not shown).

A detection result of the magnetic permeability of the Y developer obtained by the T sensor 9Y is sent as a voltage signal to a control unit (not shown). As the magnetic permeability of the Y developer shows an interrelationship with the concentration of the Y toner of the Y developer, the T sensor 9Y outputs a voltage corresponding to the Y toner concentration. The control unit is provided with RAM that stores data on Vtref for Y, which is a target value of the output voltage from the T sensor 9Y, and data on Vtref for M, Vtref for C and Vtref for K, which are target values of output voltages from T sensors for M, C and K installed in other developing devices. The developing device 5Y compares the Vtref for Y with the value of the output voltage from the T sensor 9Y and drives the after-mentioned toner supply device for Y for only a period of time corresponding to the comparison result. This driving allows the Y developer, whose Y toner has been consumed due to the development and which has decreased in Y toner concentration, to be supplied with an appropriate amount of the Y toner in the first agent accommodating portion 8Y. Thus, the Y toner concentration of the Y developer in the second agent accommodating portion 13Y is kept within a predetermined range. Similar toner supply control is carried out on developers in the process cartridges (1M, 1C and 1K) for the other colors.

The Y toner image formed on the photoconductor 2Y serving as an image bearing member is subjected to intermediate transfer to an intermediate transfer belt 41 shown in FIG. 3. The drum cleaning device 3Y removes toner remaining on the surface of the photoconductor 2Y after the intermediate transfer. The surface of the photoconductor 2Y thereby cleaned is subjected to charge elimination by a charge eliminating device (not shown). By this charge elimination, the surface of the photoconductor 2Y is initialized and preparations are thus made for the next image formation. Regarding FIG. 3, in the process cartridges 1M, 1C and 1K as well, M, C and K toner images are similarly formed on photoconductors 2M, 2C and 2K respectively and then subjected to intermediate transfer in a superimposed manner onto the intermediate transfer belt 41.

Below (in the drawing) the process cartridges 1Y, 1M, 1C and 1K, there is provided an optical writing unit 20. The optical writing unit 20 serving as a latent image forming unit irradiates the photoconductors in the process cartridges 1Y, 1M, 1C and 1K with laser light L emitted based upon image information. This allows latent electrostatic images for Y, M, C and K to be formed on the photoconductors 2Y, 2M, 2C and 2K respectively. More specifically, the optical writing unit 20 deflects the laser light L, emitted from a light source, with a polygon mirror 21 rotationally driven by a motor, and irradiates the photoconductors 2Y, 2M, 2C and 2K with the laser light L by means of a plurality of optical lenses and/or mirrors. As the light source, a light source employing an LED instead of a laser diode may be employed.

Below (in the drawing) the optical writing unit 20, a first paper feed cassette 31 and a second paper feed cassette 32 are placed such that they are laid one over the other in a vertical direction. In each of these paper feed cassettes, transfer paper P serving as a recording medium is accommodated as a sheaf of transfer paper composed of a plurality of sheets, and a first paper feed roller 31*a* and a second paper feed roller 32*a* are respectively in contact with the sheets of the transfer paper P that are placed at the tops. When the first paper feed roller 31*a* is rotationally driven in a counterclockwise direction in the drawing by a drive unit (not shown), the sheet of the transfer paper P at the top in the first paper feed cassette 31 is discharged toward a paper feed path 33 placed so as to extend in a vertical direction on the right-hand side (in the drawing) of the cassette. Meanwhile, when the second paper feed roller 32*a* is rotationally driven in a counterclockwise direction in the drawing by a drive unit (not shown), the sheet of the transfer paper P at the top in the second paper feed cassette 32 is discharged toward the paper feed path 33. A plurality of pairs of conveyance rollers 34 are provided in the paper feed path 33, and the transfer paper P sent to the paper feed path 33 is conveyed in the paper feed path 33 from the lower side toward the upper side in the drawing, sandwiched between the pairs of conveyance rollers 34.

A pair of registration rollers 35 is provided at an end of the paper feed path 33. As soon as the transfer paper P sent from the pairs of conveyance rollers 34 is sandwiched between the pair of registration rollers 35, the rollers are temporarily stopped from rotating. Then the rollers send the transfer paper P toward the after-mentioned secondary transfer nip with appropriate timing.

Above (in the drawing) the process cartridges 1Y, 1M, 1C and 1K, there is provided a transfer unit 40 which allows the intermediate transfer belt 41 as an intermediate transfer member to move endlessly in a counterclockwise direction in the drawing while allowing the intermediate transfer belt 41 to be set in a stretched manner. This transfer unit 40 includes a belt cleaning device 42, a first bracket 43, a second bracket 44 and so forth, besides the intermediate transfer belt 41. It also includes four primary transfer rollers 45Y, 45M, 45C and 45K, a secondary transfer backup roller 46, a drive roller 47, an auxiliary roller 48, a tension roller 49 and so forth. Set on these eight rollers in a stretched manner, the intermediate transfer belt 41 is endlessly moved in a counterclockwise direction in the drawing by the rotational driving of the drive roller 47. The four primary transfer rollers 45Y, 45M, 45C and 45K form respective primary transfer nips, as the intermediate transfer belt 41 thusly endlessly moved is sandwiched between the primary transfer rollers and the photoconductors 2Y, 2M, 2C and 2K. A transfer bias having a polarity (for example, a positive polarity) opposite to the polarity of the toner is applied to the back surface (loop inner circumferential surface) of the intermediate transfer belt 41. As the intermediate transfer belt 41 sequentially passes through the primary transfer nips for Y, M, C and K due to its endless movement, the Y, M, C and K toner images on the photoconductors 2Y, 2M, 2C and 2K are primarily transferred in a superimposed manner onto the front surface of the intermediate transfer belt 41. This allows a toner image with four colors combined (hereinafter referred to as "four-color toner image") to be formed on the intermediate transfer belt 41.

The secondary transfer backup roller 46 forms a secondary transfer nip, as the intermediate transfer belt 41 is sandwiched between the secondary transfer backup roller and a secondary transfer roller 50 placed outside the loop of the intermediate transfer belt 41. The pair of registration rollers 35 earlier explained sends the transfer paper P, sandwiched between the rollers, toward the secondary transfer nip with such a timing as enables synchronization with the four-color toner image on the intermediate transfer belt 41. Affected by a secondary transfer electric field formed between the secondary transfer backup roller 46 and the secondary transfer roller 50 to which a secondary transfer bias is applied, and also affected by nip pressure, the four-color toner image on the intermediate transfer belt 41 is secondarily transferred at one time to the transfer paper P inside the secondary transfer nip. As the four-color toner image combines with the white color of the transfer paper P, a full-color toner image is obtained.

To the part of the intermediate transfer belt 41 having passed the secondary transfer nip, residual toner that was not transferred to the transfer paper P is attached. This residual toner is cleaned off by the belt cleaning device 42.

Above (in the drawing) the secondary transfer nip, there is provided a fixing device 60 including a pressurizing roller 61, a fixing belt unit 62 and so forth. The fixing belt unit 62 of this fixing device 60 allows a fixing belt 64 to move endlessly in a counterclockwise direction in the drawing while allowing this fixing belt to be set on a heating roller 63, a tension roller 65 and a drive roller 66 in a stretched manner. The heating roller 63 envelops a heat source such as a halogen lamp and heats the fixing belt 64 from the back surface side of the belt. The part of the thusly heated fixing belt 64 situated on the heating roller 63 is touched by the pressurizing roller 61, which is rotationally driven in a clockwise direction in the drawing, from the front surface side of this belt. Thus, a fixing nip where the pressurizing roller 61 touches the fixing belt 64 is formed.

The transfer paper P having passed the secondary transfer nip is separated from the intermediate transfer belt 41 and subsequently sent into the fixing device 60. Then, in a process where the transfer paper P is conveyed from the lower side toward the upper side in the drawing while sandwiched at the fixing nip, the full-color toner image is fixed to the transfer paper P by being heated, pressed, etc. by the fixing belt 64.

The transfer paper P thusly subjected to the image fixation is passed between a pair of discharge rollers 67 and then discharged to the exterior side of the printer. A stack section 68 is formed on the upper surface of the housing of the printer main body, and sheets of the transfer paper P discharged to the exterior side by the pair of discharge rollers 67 are sequentially stacked at this stack section 68.

Above the transfer unit 40, there are provided four toner cartridges 100Y, 100M, 100C and 100K serving as toner containers to accommodate the Y, M, C and K toners respectively. The Y, M, C and K toners (not shown) in the toner cartridges 100Y, 100M, 100C and 100K are suitably supplied to the respective developing devices of the process cartridges 1Y, 1M, 1C and 1K. These toner cartridges 100Y, 100M, 100C and 100K are detachably mountable to the printer main body independently of the process cartridges 1Y, 1M, 1C and 1K.

In the printer with the above-mentioned structure, members such as the four process cartridges 1Y, 1M, 1C and 1K and the optical writing unit 20 constitute an image forming unit configured to form a toner image.

Figure 5:
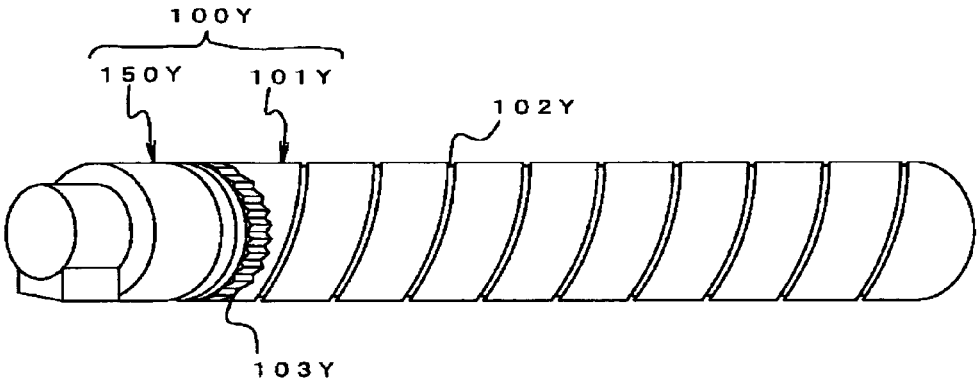
FIG. 5 is a perspective view showing a toner cartridge for Y in the printer.

FIG. 5 is a perspective view showing the toner cartridge 100Y for Y. In the drawing, the toner cartridge 100Y for Y includes a cylindrical container 101Y to accommodate the Y toner (not shown), and a cap portion 150Y. It also includes the after-mentioned sealing member (not shown).

Figure 6:
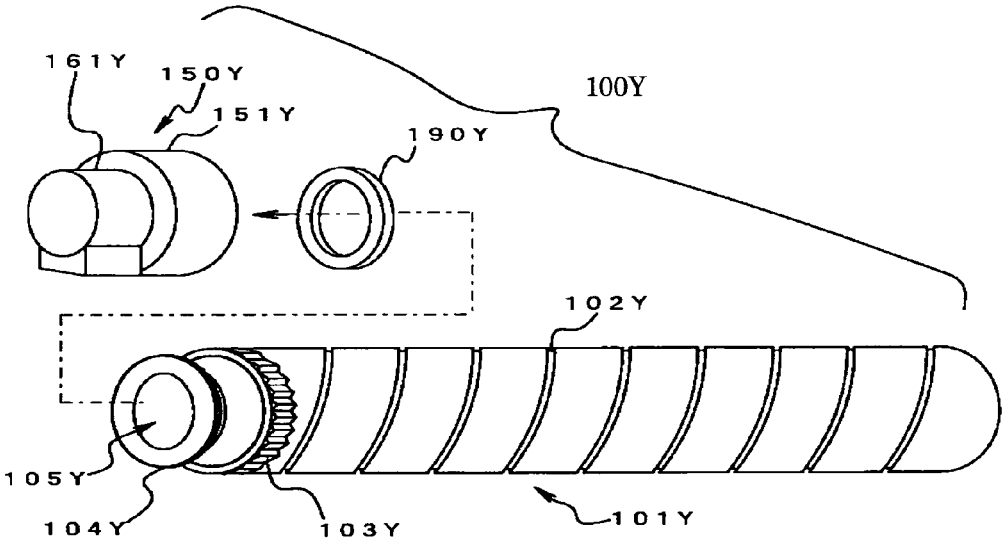
FIG. 6 is an exploded perspective view showing the toner cartridge.

As shown in FIG. 6, the cap portion 150Y receives an end (with respect to the cylinder axis direction) of the cylindrical container 101Y on its inside in such a manner as to cover the end of the cylindrical container 101Y. In the circumferential surface of the cylindrical container 101Y, a spiral groove 102Y that is depressed in a spiral from the outer side toward the inner side of the container is formed. Also, a gear portion 103Y to engage with a driving gear of a toner supply device (not shown), and an outer circumferential protrusion 104Y protruding so as to extend around a whole circumference with respect to the circumferential direction are formed at the circumferential surface of the cylindrical container 101Y. Further, at the end (with respect to the cylinder axis direction) of the cylindrical container 101Y, a container opening 105Y in the shape of a round hole is formed in such a manner as to face ahead with respect to the cylinder axis direction.

The cap portion 150Y has a double cylinder structure where a large-diameter cylindrical structure 151Y, which is a cylindrical structure of relatively large diameter, and a small-diameter cylindrical structure 161Y, which is a cylindrical structure of relatively small diameter, are concentrically laid one on top of the other with respect to the axis direction.

Figure 7:
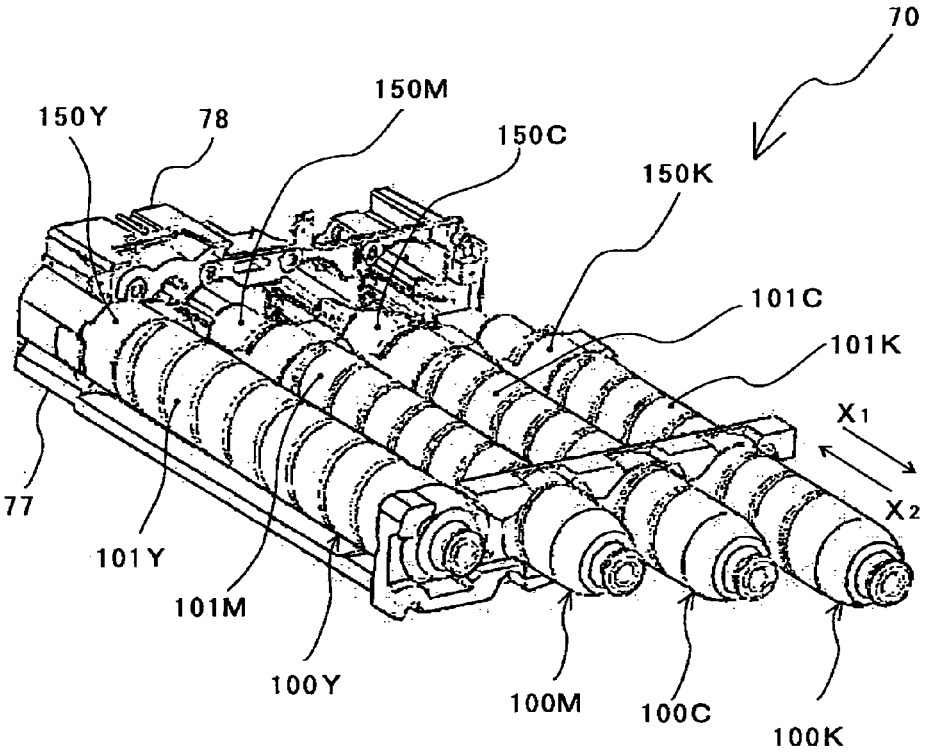
FIG. 7 is a perspective view showing a toner supply device in the printer.

FIG. 7 is a perspective view showing a toner supply device in the printer. In the drawing, a toner supply device 70 includes a cartridge-mounting stand 77 to mount the four toner cartridges 100Y, 100M, 100C and 100K on, a cylinder drive unit 78 to rotationally drive the toner cartridges' cylindrical containers 101Y, 101M, 101C and 101K individually, and so forth. Cap portions 150Y, 150M, 150C and 150K of the toner cartridges 100Y, 100M, 100C and 100K set on the cartridge-mounting stand 77 engage with the cylinder drive unit 78 of the toner supply device 70. As shown by the arrow $X_1$ in the drawing, when the toner cartridge 100K is slid away from the cylinder drive unit 78 on the cartridge-mounting stand 77, the cap portion of the toner cartridge 100K detaches from the cylinder drive unit 78. In this manner, the toner cartridge 100K can be detached from the toner supply device 70.

Regarding the toner supply device 70 without the toner cartridge 100K being attached thereto, when the toner cartridge 100K is slid toward the cylinder drive unit 78 on the cartridge-mounting stand 77 as shown by the arrow $X_2$ in the drawing, the cap portion of the toner cartridge 100K engages with the cylinder drive unit 78. In this manner, the toner cartridge 100K can be attached to the toner supply device 70. The toner cartridges 100Y, 100M and 100C for the other colors, too, can be attached to the toner supply device 70 by conducting a similar operation.

The above-mentioned gear portion (not shown) is formed at the outer circumferential surface of the end of each of the cylindrical containers 101Y, 101M, 101C and 101K of the toner cartridges 100Y, 100M, 100C and 100K. When the cap portions 150Y, 150M, 150C and 150K of the toner cartridges 100Y, 100M, 100C and 100K engage with the cylinder drive unit 78, driving gears (not shown) for Y, M, C and K provided at the cylinder drive unit 78 engage with the gear portions 103Y, 103M, 103C and 103K of the cylindrical containers 101Y, 101M, 101C and 101K respectively. As the driving gears for Y, M, C and K at the cylinder drive unit 78 are rotationally driven by a drive system (not shown), the cylindrical containers 101Y, 101M, 101C and 101K are rotationally driven on the cap portions 150Y, 150M, 150C and 150K.

In FIG. 5 earlier mentioned, when the cylindrical container 101Y is rotationally driven on the cap portion 150Y in this manner, the Y toner in the cylindrical container 101Y moves along the above-mentioned spiral groove 102Y from the rear end side toward the front end side with respect to the rotational axis direction. Then the Y toner flows into the cap portion 150Y through the container opening (not shown) corresponding to 105Y in FIG. 6, provided in the end of the cylindrical container 101Y.

Next, a characteristic structure of the printer according to the embodiment will be explained.

Figure 8:
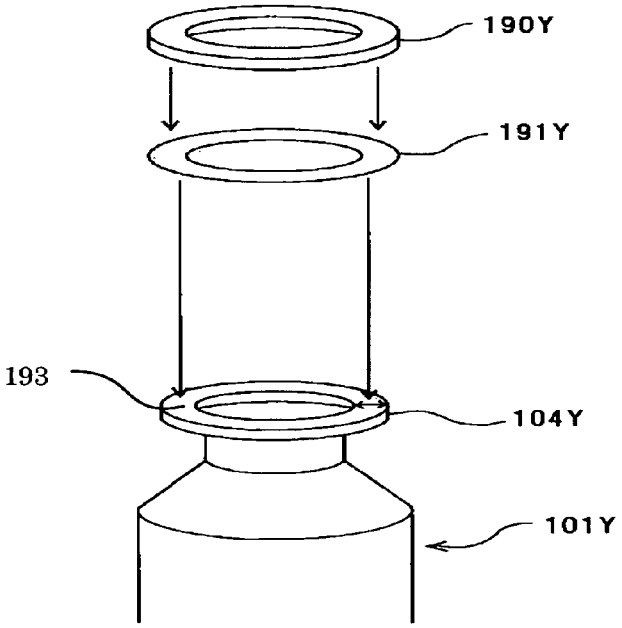
FIG. 8 is an enlarged perspective view showing an end of a cylindrical container of the toner cartridge.

FIG. 8 is an enlarged perspective view showing the end of the cylindrical container 101Y. The outer circumferential protrusion 104Y of the cylindrical container 101Y is provided at the furthermost end of the cylindrical container 101Y, unlike in conventional cases. Also, the amount by which the outer circumferential protrusion protrudes from the outer circumferential surface of the cylindrical container 101Y with respect to a normal direction is larger than in conventional cases. With the foregoing increased protrusion amount, the lateral surface of the outer circumferential protrusion 104Y is made a ring larger in area than that of a ring-shaped sealing member 190Y and thus forms a seal receiving surface 193. To the surface on one side of the sealing member 190Y, a double-sided tape 191Y in the shape of a ring with the same size is affixed. The sealing member 190Y is affixed to the seal receiving surface 193, which is the lateral surface of the outer circumferential protrusion 104Y, with the double-sided tape 191Y.

Figure 9:
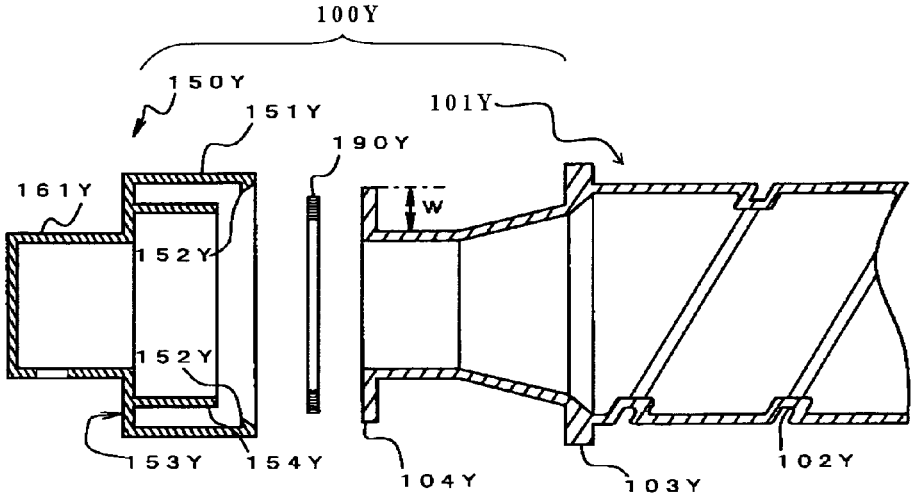
FIG. 9 is an enlarged longitudinal cross-sectional view showing an end of the toner cartridge before the toner cartridge is assembled.

FIG. 9 is an enlarged longitudinal cross-sectional view showing the end of the toner cartridge 100Y before the toner cartridge is assembled. In the large-diameter cylindrical structure 151Y of the cap portion 150Y shown in the drawing, a large opening in the shape of a circle is formed at one end with respect to the cylinder axis direction (on the right-hand side in the drawing). This opening serves as a reception opening through which to receive the end of the cylindrical container 101Y. Meanwhile, the small-diameter cylindrical structure 161Y is joined to the other end (with respect to the cylinder axis direction) of the large-diameter cylindrical structure 151Y. At this jointing position (mounting position), the large-diameter cylindrical structure 151Y protrudes in the form of a ring and farther in a normal direction than the small-diameter cylindrical structure 161Y. The part protruding in the form of a ring as just described is a ring-shaped apical wall 153Y of the large-diameter cylindrical structure 151Y. On the inner surface of this ring-shaped apical wall 153Y, a cylindrical inner wall 154Y, whose diameter is smaller than that of the outer circumferential wall of the large-diameter cylindrical structure 151Y, is placed in an upright position.

The end of the cylindrical container 101Y is tapered, and a portion slightly behind the position where the cylindrical container starts tapering is provided with the gear portion 103Y which protrudes so as to extend around the whole circumference of the outer circumferential surface of the cylinder. As described above, the outer circumferential protrusion 104Y protruding from the outer circumferential surface by a protrusion amount greater than in conventional cases is formed at the position of the furthermost end of the cylindrical container 101Y. The ring-shaped sealing member 190Y is affixed to the seal receiving surface, i.e., the end surface of the outer circumferential protrusion 104Y.

On the inner circumferential surface of the large-diameter cylindrical structure 151Y of the cap portion 150Y, a hook portion 152Y is provided in the vicinity of the end with respect to the cylinder axis direction in such a manner as to protrude toward the inner side of the cylinder. The rear end side (with respect to the cylinder axis direction) of this hook portion 152Y is in a tapered form, diagonally rising toward the front end side thereof, whereas the front end side thereof rises substantially vertically from the inner circumferential surface of the large-diameter cylindrical structure 151Y. This surface which rises substantially vertically serves as a catching surface for catching the outer circumferential protrusion 104Y.

Figure 10:
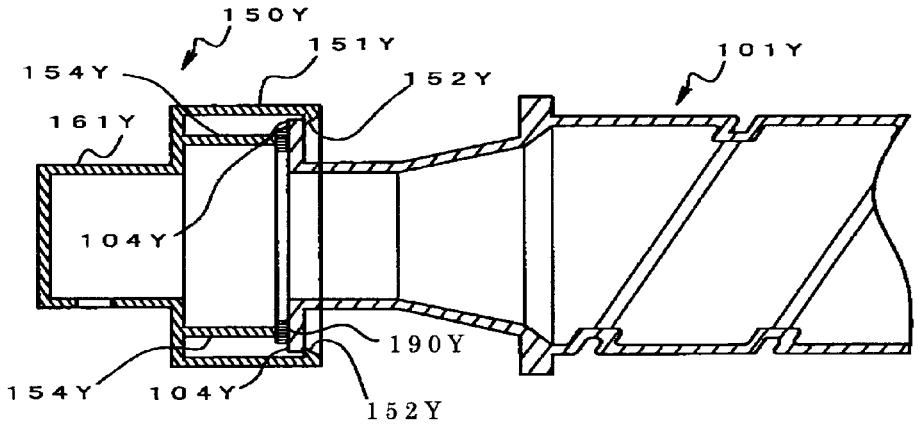
FIG. 10 is an enlarged longitudinal cross-sectional view showing the end after the toner cartridge has been assembled.

When the end of the cylindrical container 101Y is inserted into the cap portion 150Y, the outer circumferential protrusion 104Y of the cylindrical container 101Y moves beyond the hook portion 152Y of the large-diameter cylindrical structure 151Y of the cap portion 150Y. Then the sealing member 190Y, which is made of foamed polyurethane, affixed to the end of the cylindrical container 101Y hits the cylindrical inner wall 154Y in the to large-diameter cylindrical structure 151Y and adheres thereto, as shown in FIG. 10. In this state, the outer circumferential protrusion 104Y of the cylindrical container 101Y is caught by the catching surface of the hook portion 152Y. Thus, the cylindrical container 101Y is rotatably held by the cap portion 150Y without detaching from the cap portion 150Y.

Figure 11:
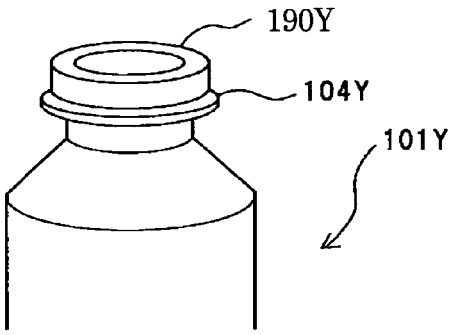
FIG. 11 is an enlarged perspective view showing an end of a cylindrical container with a sealing member affixed thereto.

In the printer according to the embodiment, it is possible to suppress the occurrence of twisting of the sealing member 190Y, which rubs against the rotating cylindrical container 101Y, by affixation of the sealing member 190Y to the seal receiving surface (lateral surface of the outer circumferential protrusion 104Y) of the cylindrical container 101Y, which comes into contact with the whole area of the surface on one side of the sealing member 190Y. Moreover, a wall, exemplified by the cylindrical circumferential wall of the cap portion, that hinders access of a human hand is not present at the end of the cylindrical container 101Y received by the cap portion 150Y, as shown in FIG. 11; therefore, the sealing member 190Y affixed to the lateral surface of the outer circumferential protrusion 104Y, which serves as the seal receiving surface, at the end can be easily removed by the human hand. Hence, the sealing member 190Y can be easily reaffixed and replaced.

The ring width (denoted by W in FIG. 9) of the ring-shaped seal receiving surface formed by the lateral surface of the outer circumferential protrusion 104Y is desirably 1.5 mm or greater. In the printer according to the embodiment, the ring width W is set at 5 mm. The thickness of the sealing member 190Y is set at 3 mm. As the double-sided tape with which to stick the sealing member 190Y and the seal receiving surface together, No. 5000NS manufactured by NITTO DENKO CORPORATION is used. As the foamed polyurethane that is the material for the sealing member 190Y, PORON LE-20LF manufactured by INOAC CORPORATION is used. As the cylindrical container 101Y, polyethylene terephthalate subjected to injection molding is used. Since the seal receiving surface, too, is subjected to injection molding at the same time, the seal receiving surface can be made superior in flatness.

The outer circumferential protrusion 104Y is made to rise by 5 mm from the end (which is 30 mm in diameter) of the cylindrical container 101Y, and the external diameter of the outer circumferential protrusion 104Y is set at 40 mm. The thickness of the outer circumferential protrusion 104Y is set at 1.5 mm.

EXAMPLES

The following explains Examples each employing the printer according to the embodiment provided with an even more characteristic structure.

First Example

Figure 12:
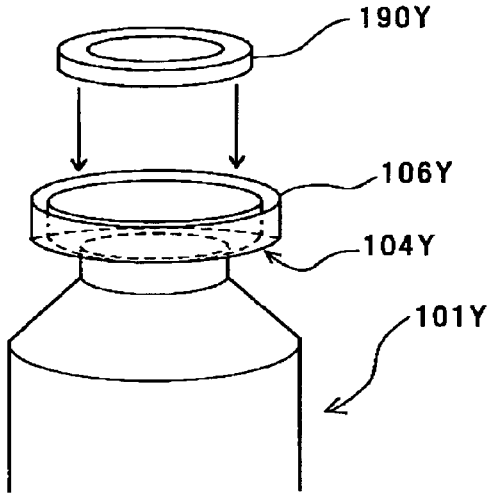
FIG. 12 is a perspective view showing an end of a cylindrical container of a printer according to First Example.
Figure 13:
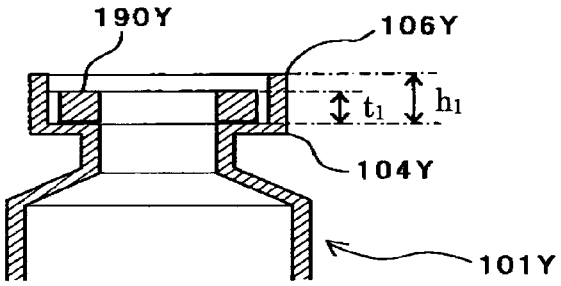
FIG. 13 is a cross-sectional view showing the end of the cylindrical container.

FIG. 12 is a perspective view showing an end of a cylindrical container 101Y of a printer according to First Example. FIG. 13 is a cross-sectional view showing the end of the cylindrical container 101Y. Regarding this cylindrical container 101Y, an outer wall 106Y which rises from a ring-shaped seal receiving surface formed by the lateral surface of an outer circumferential protrusion 104Y is provided on an outer circumferential edge of the seal receiving surface. By thusly providing the outer wall 106Y, a positioning operation can easily be carried out at the time when a sealing member 190Y is affixed to the seal receiving surface.

The outer wall 106Y has a height (denoted by $h_1$ in FIG. 13) which is greater than a thickness (denoted by $t_1$ in FIG. 13) of the sealing member 190Y. With the height thusly set, the sealing member 190Y is protected with the outer wall 106Y and thus does not hit the hook portion 152Y, when the end of the cylindrical container 101Y is inserted into the cap portion 150Y shown in FIG. 9 earlier mentioned, thereby making it possible to avoid breakage of the sealing member 190Y during the insertion.

In First Example, the height $h_1$ of the outer wall 106Y is set at 4 mm and the thickness $t_1$ of the sealing member 190Y is set at 3 mm.

Second Example

Figure 14:
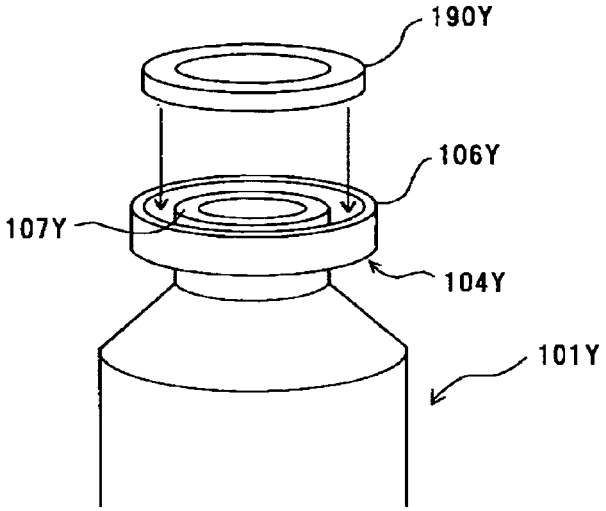
FIG. 14 is a perspective view showing an end of a cylindrical container of a printer according to Second Example.
Figure 15:
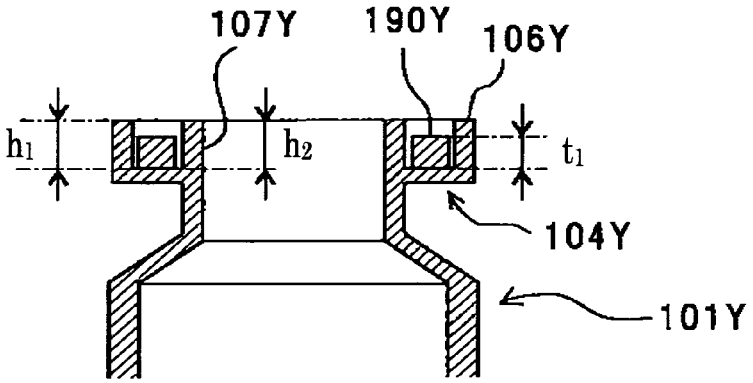
FIG. 15 is a cross-sectional view showing the end of the cylindrical container.

FIG. 14 is a perspective view showing an end of a cylindrical container 101Y of a printer according to Second Example. FIG. 15 is a cross-sectional view showing the end of the cylindrical container 101Y. This cylindrical container 101Y includes, besides an outer wall 106Y which rises from an outer circumferential edge of a ring-shaped seal receiving surface that is the lateral surface of an outer circumferential protrusion 104Y, an inner wall 107Y which rises from an inner circumferential edge of the ring-shaped seal receiving surface. A sealing member 190Y is inserted between the outer wall 106Y and the inner wall 107Y and held on the seal receiving surface. By surrounding the outside of the sealing member 190Y with the outer wall 106Y and surrounding the inside of the sealing member 190Y with the inner wall 107Y, displacement of the sealing member 190Y can be prevented even when the sealing member 190Y is rubbed against the seal receiving surface or a cap portion (not shown). Accordingly, the sealing member 190Y is held on the seal receiving surface without being affixed to the seal receiving surface. In the inventions regarding claims of the present application, the expression "fixing a/the sealing member" includes an aspect where the sealing member is held as in this Example.

As just described, by making affixation of the sealing member 190Y not necessary, it is possible to reduce production costs. In Second Example, the sealing member 190Y has a thickness $t_1$ of 3 mm, the outer wall 106Y has a height $h_1$ of 4 mm and the inner wall 107Y has a height $h_2$ of 4 mm. The sealing member 190Y has a ring width of 3 mm. PORON LE-20LF manufactured by INOAC CORPORATION is used as foamed polyurethane that is the material for the sealing member 190Y.

Third Example

Figure 16:
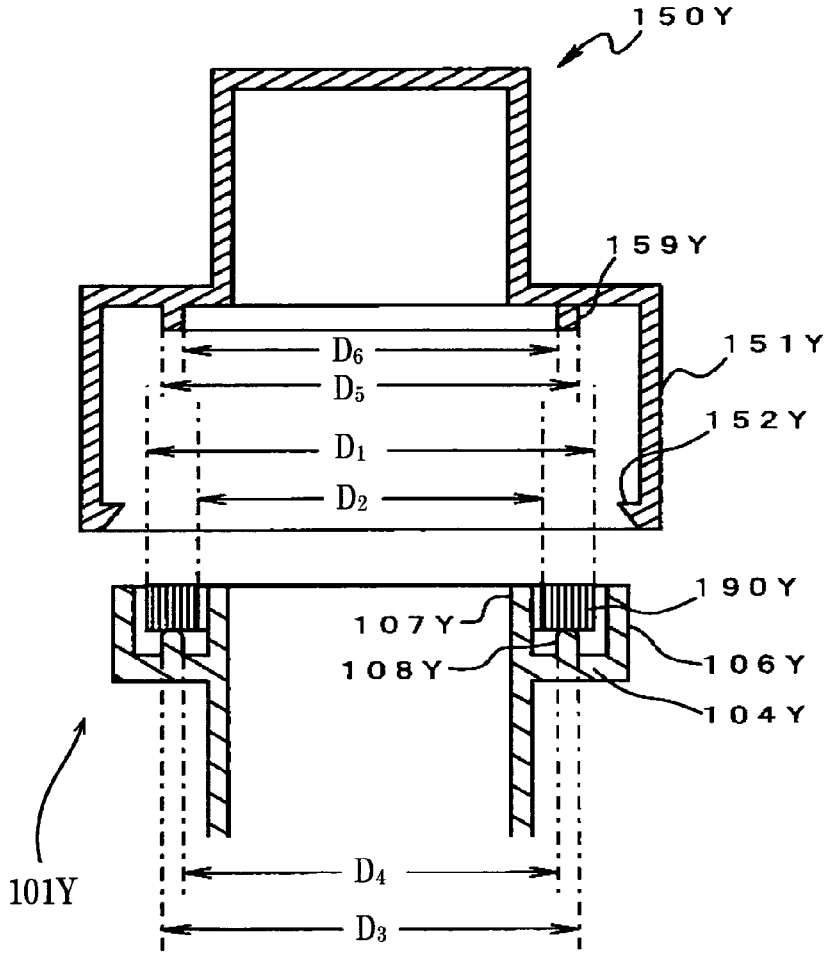
FIG. 16 is an exploded cross-sectional view showing an end of a toner cartridge for Y in a printer according to Third Example.

FIG. 16 is an exploded cross-sectional view showing an end of a toner cartridge 100Y for Y in a printer according to Third Example. Regarding a cylindrical container 101Y shown in the drawing, a seal receiving surface surrounded by an outer wall 106Y and an inner wall 107Y is provided with a ring-shaped protrusion 108Y. This ring-shaped protrusion 108Y has an external diameter $D_3$ which is smaller than an external diameter $D_1$ of a sealing member 190Y. Also, this ring-shaped protrusion 108Y has an internal diameter $D_4$ which is larger than an internal diameter $D_2$ of the sealing member 190Y.

A ring-shaped protrusion 159Y is provided on a surface in a cap portion 150Y opposite the seal receiving surface of the cylindrical container 101Y. This ring-shaped protrusion 159Y has an external diameter $D_5$ which is smaller than the external diameter $D_1$ of the sealing member 190Y. Also, this ring-shaped protrusion 159Y has an internal diameter $D_6$ which is larger than the internal diameter $D_2$ of the sealing member 190Y.

Figure 17:
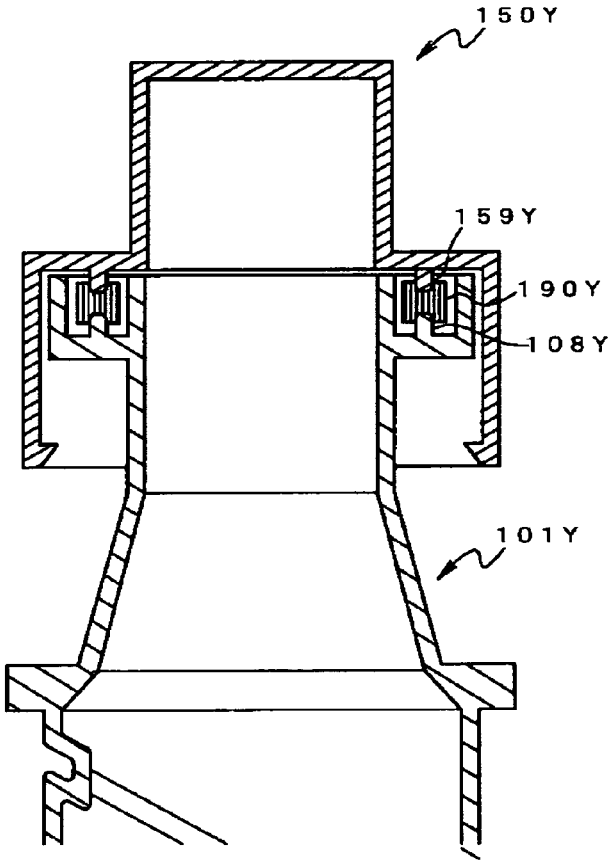
FIG. 17 is a cross-sectional view showing an end of a cylindrical container when the end has been inserted into a cap portion.

When an end of the cylindrical container 101Y has been inserted into the cap portion 150Y, the sealing member 190Y deforms, sandwiched between the ring-shaped protrusion 159Y of the cap portion 150Y and the ring-shaped protrusion 108Y of the cylindrical container 101Y, as shown in FIG. 17. Thus, airtightness between the cap portion 150Y and the cylindrical container 101Y can be secured.

In Third Example, the internal diameter $D_2$ of the sealing member 190Y is set at 32 mm and the external diameter $D_1$ thereof is set at 36 mm. As for the ring-shaped protrusion 159Y of the cap portion 150Y and the ring-shaped protrusion 108Y of the cylindrical container 101Y, the external diameters $D_3$ and $D_5$ are both set at 34.5 mm and the internal diameters $D_4$ and $D_6$ are both set at 33.5 mm. Both those ring-shaped protrusions have a height of 1.5 mm.

Figure 18:
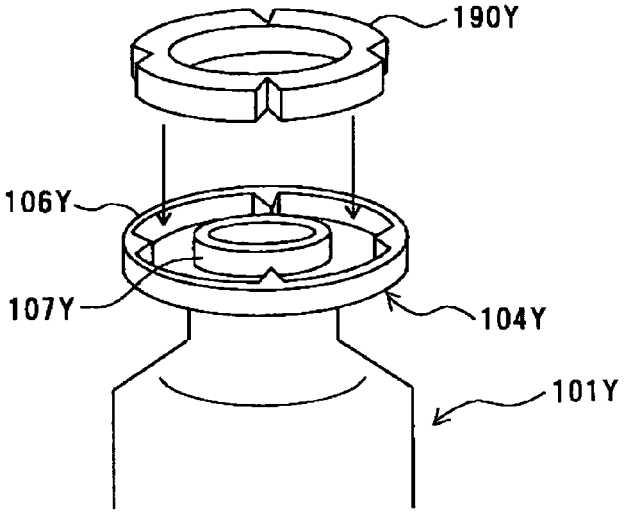
FIG. 18 is an enlarged perspective view showing the end of the cylindrical container.

FIG. 18 is an enlarged perspective view showing the end of the cylindrical container 101Y. Regarding this cylindrical container 101Y, a concavo-convex pattern which has a level difference with respect to a normal direction is provided at the inner circumferential surface of the outer wall 106Y. Further, an engaging concavo-convex pattern which can engage with the concavo-convex pattern is provided at an outer edge of the ring-shaped sealing member 190Y. In the foregoing structure, by allowing these patterns to engage with each other, the sealing member 190Y is caught by convex portions of the outer wall 106Y and thus rotation of the sealing member 190Y caused by the rotation of the cylindrical container 101Y can be avoided.

Figure 19:
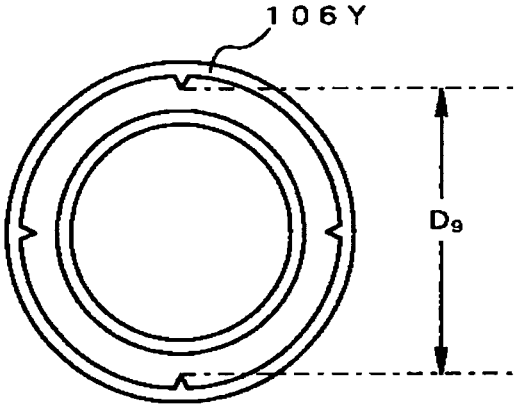
FIG. 19 is a front view showing the end of the cylindrical container as seen from in front.
Figure 20:
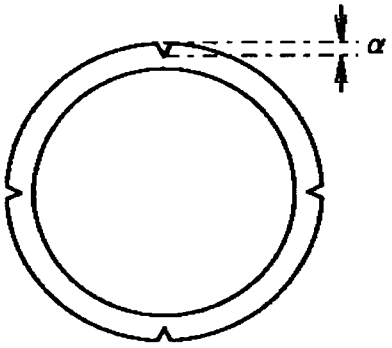
FIG. 20 is a plan view showing a sealing member of the toner cartridge.

On the inside of the outer wall 106Y, convex portions of the concavo-convex pattern shown in FIG. 19 have an internal diameter $D_9$ of 38 mm. As for the sealing member 190Y, a concave portion of the engaging concavo-convex pattern shown in FIG. 20 has a depth a of 2 mm. The sealing member 190Y has a thickness of 3 mm and a ring width of 3 mm. PORON LE-20LF manufactured by INOAC CORPORATION is used as foamed polyurethane that is the material for the sealing member 190Y.

In the printer according to First Example, the outer wall 106Y rising from the seal receiving surface of the cylindrical container 101Y is provided on the outer circumferential edge of the seal receiving surface. With the foregoing structure, a positioning operation can easily be carried out at the time when the sealing member 190Y is affixed to the seal receiving surface.

Also in the printer according to First Example, the height $h_1$ of the outer wall 106Y is greater than the thickness $t_1$ of the sealing member 190Y. With the foregoing structure, breakage of the sealing member 190Y can be avoided by protecting it with the outer wall 106Y, when the end of the cylindrical container 101Y is inserted into the cap portion 150Y.

In the printer according to Second Example, the sealing member 190Y is a ring-shaped sealing member, and the seal receiving surface is a ring-shaped seal receiving surface; also, the inner wall 107Y rising from the seal receiving surface is provided on the inner circumferential edge of the seal receiving surface. With the foregoing structure, it is possible to reduce costs, making affixation of the sealing member 190Y not necessary, because displacement of the sealing member 190Y can be prevented even when the sealing member 190Y is rubbed against the seal receiving surface or the cap portion (not shown).

In the printer according to Third Example, the ring-shaped protrusion 108Y, whose external diameter $D_3$ is smaller than the external diameter $D_1$ of the sealing member 190Y and whose internal diameter $D_4$ is greater than the internal diameter $D_2$ of the sealing member 190Y, is provided on the seal receiving surface. Further, the ring-shaped protrusion 159Y, whose external diameter $D_5$ is smaller than the external diameter $D_1$ of the sealing member 190Y and whose internal diameter $D_6$ is greater than the internal diameter $D_2$ of the sealing member 190Y, is provided on the surface in the cap portion 150Y opposite the seal receiving surface. With the foregoing structure, it is possible to favorably secure airtightness between the cap portion 150Y and the cylindrical container 101Y by sandwiching the sealing member 190Y between the ring-shaped protrusion 159Y of the cap portion 150Y and the ring-shaped protrusion 108Y of the cylindrical container 101Y and thusly deforming the sealing member 190Y.

Also in the printer according to Third Example, the concavo-convex pattern which has a level difference with respect to the normal direction is provided at the inner circumferential surface of the outer wall 106Y, and the engaging concavo-convex pattern which can engage with the concavo-convex pattern is provided at the outer edge of the sealing member 190Y. With the foregoing structure, by allowing these patterns to engage with each other, the sealing member 190Y is caught by the convex portions of the outer wall 106Y and thus rotation of the sealing member 190Y caused by the rotation of the cylindrical container 101Y can be avoided.

REFERENCE SIGNS LIST

1Y, 1C, 1M and 1K: process cartridge (part of image forming unit)
20: optical writing unit (part of image forming unit)
100Y, 100M, 100C and 100K: toner cartridge (toner container)
101Y: cylindrical container
104Y: outer circumferential protrusion
150Y: cap portion
151Y: large-diameter cylindrical structure
152Y: hook portion
153Y: ring-shaped apical wall
154Y: cylindrical inner wall
161Y: small-diameter cylindrical structure
190Y: sealing member

The invention claimed is:

1. A toner container detachably mountable to a main body of an image forming apparatus, the toner container comprising:

a cylindrical container which accommodates toner;

a cap portion which holds the cylindrical container such that the cylindrical container can rotate in a circular direction, with an end of the cylindrical container inserted in the cap portion; and a sealing member which lies between the end and an inner surface of the cap portion with the end inserted therein, wherein the toner in the cylindrical container is discharged to an inside of the cap portion through an opening in the end and the toner in the cap portion is discharged to an outside through a toner discharge port in the cap portion, as the cylindrical container rotates, and wherein the cylindrical container includes a seal receiving surface for fixing the sealing member, and the sealing member is fixed to the seal receiving surface, wherein the toner container further comprises an outer wall which rises from the seal receiving surface and which is on an outer circumferential edge of the seal receiving surface.

2. The toner container according to claim 1, wherein the outer wall has a height which is greater than a thickness of the sealing member.

3. The toner container according to claim 1, further comprising an inner wall which rises from the seal receiving surface and which is on an inner circumferential edge of the seal receiving surface, wherein the sealing member is a ring-shaped sealing member, and the seal receiving surface is a ring-shaped seal receiving surface.

4. The toner container according to claim 3, further comprising a ring-shaped protrusion whose external diameter is smaller than an external diameter of the ring-shaped sealing member and whose internal diameter is greater than an internal diameter of the ring-shaped sealing member, the ring-shaped protrusion being on the seal receiving surface.

5. The toner container according to claim 4, further comprising a second ring-shaped protrusion whose external diameter is smaller than the external diameter of the ring-shaped sealing member and whose internal diameter is greater than the internal diameter of the ring-shaped sealing member, the second ring-shaped protrusion being provided on a surface in the cap portion opposite the seal receiving surface.

6. The toner container according to claim 3, further comprising a concavo-convex pattern which has a level difference with respect to a normal direction and which is at an inner circumferential surface of the outer wall, and an engaging concavo-convex pattern which can engage with the concavo-convex pattern and which is at an outer edge of the ring-shaped sealing member.

7. The toner container according to claim 1, wherein:

the securing of the sealing member is fixed to the seal receiving surface by adhering the sealing member to the seal receiving surface.

8. An image forming apparatus comprising:

an image forming unit configured to form an image, using toner; and a toner container which accommodates a toner to be supplied to the image forming unit and which is detachably mountable to a main body of the image forming apparatus, wherein the toner container comprises:

a cylindrical container which accommodates the toner;

a cap portion which holds the cylindrical container such that the cylindrical container can rotate in a circular direction, with an end of the cylindrical container inserted in the cap portion; and a sealing member which lies between the end and an inner surface of the cap portion with the end inserted therein, wherein the toner in the cylindrical container is discharged to an inside of the cap portion through an opening in the end and the toner in the cap portion is discharged to an outside through a toner discharge port in the cap portion, as the cylindrical container rotates, and wherein the cylindrical container includes a seal receiving surface for fixing the sealing member, and the sealing member is fixed to the seal receiving surface, wherein the toner container further comprises an outer wall which rises from the seal receiving surface and which is on an outer circumferential edge of the seal receiving surface.

9. The image forming apparatus according to claim 8, wherein:

the sealing member is fixed to the seal receiving surface by adhering the sealing member to the seal receiving surface.

10. A toner container producing method comprising:

placing a seal on a seal receiving surface of a cylindrical container, the seal receiving surface including an outer wall which rises therefrom and is on an outer circumferential edge of the seal receiving surface; and engaging an end of the cylindrical container at which the seal receiving surface is located with a cap portion to secure the seal to the seal receiving surface, the cap portion for receiving toner from the cylindrical container and for discharging toner from a toner discharge port in the cap portion.

11. The method according to claim 10, wherein the securing of the seal to the seal receiving surface comprises:

adhering the sealing member to the seal receiving surface.

* * * * *